United States Patent [19]

Ruff

[11] Patent Number: 4,901,781

[45] Date of Patent: Feb. 20, 1990

[54] METHOD OF CASTING A METAL MATRIX COMPOSITE

[75] Inventor: Gary F. Ruff, Farmington Hills, Mich.

[73] Assignee: General Motors Corporation, Detroit, Mich.

[21] Appl. No.: 238,321

[22] Filed: Aug. 30, 1988

[51] Int. Cl.[4] ..... B22D 18/06; B22D 19/14

[52] U.S. Cl. ..... 164/63; 164/197; 164/499

[58] Field of Search ..... 164/900, 97, 498, 499, 164/500, 48, 146, 147.1, 250.1, 511, 513, 61, 62, 63, 65, 119

[56] References Cited

U.S. PATENT DOCUMENTS

| | | | |
|---|---|---|---|
| 3,286,334 | 7/1965 | Hay | 29/528 |
| 3,863,706 | 2/1975 | Chandley et al. | 164/255 |
| 3,900,064 | 8/1975 | Chandley et al. | 164/306 |
| 4,340,108 | 7/1982 | Chandley et al. | 164/63 |
| 4,573,517 | 3/1986 | Booth et al. | 164/61 |
| 4,616,691 | 10/1986 | Voss | 164/255 |
| 4,658,880 | 4/1987 | Voss | 164/255 |

FOREIGN PATENT DOCUMENTS

| | | | |
|---|---|---|---|
| 60-77946 | 5/1985 | Japan | 164/97 |
| 62-161450 | 7/1987 | Japan | 164/97 |

OTHER PUBLICATIONS

Metal Matrix Composites for Automobiles, *Society of Automotive Engineers*, vol. 94, No. 12, 1986.

*Primary Examiner*—Richard K. Seidel

*Attorney, Agent, or Firm*—Reising, Ethington, Barnard, Perry & Milton

[57] ABSTRACT

A method of casting a metal matrix composite involves countergravity filling a bottom-gated casting mold from an underlying, initially homogenous, two-phase melt of solid reinforcing particles in a molten metal while continuously inductively stirring the melt during countergravity filling of the mold to minimize subsequent clumping or agglomeration of the reinforcing particles therein during mold filling. After the casting mold is filled, the melt in the mold may be inductively stirred during solidification therein to minimize subsequent clumping or agglomeration of the reinforcing particles in the solidifying melt. A cast metal matrix composite having the reinforcing particles uniformly dispersed in a metal matrix and substantially free of objectionable clusters of the reinforcing particles in the metal matrix is thereby provided.

4 Claims, 2 Drawing Sheets

METHOD OF CASTING A METAL MATRIX COMPOSITE

FIELD OF THE INVENTION

The invention relates to a method of casting a metal matrix composite from an initially homogeneous, two-phase melt of solid reinforcing particles in a molten metal in such a manner to substantially maintain said homogeneity and minimize subsequent agglomeration of the solid reinforcing particles in the melt during various stages of the casting process.

BACKGROUND OF THE INVENTION

Dispersion strengthened or reinforced metal matrix composites have been developed for aerospace, automobile and other applications where light-weight materials with improved physical (mechanical) properties, such as tensile strength, elongation, wear resistance, etc., are required. Metal matrix composites generally comprise solid reinforcing particles, such as ceramic or graphite reinforcing particles, dispersed uniformly throughout a metal matrix. The reinforcing particles may assume various forms including fibers, whiskers, rods, spheres and the like, and may be present in the metal matrix in amounts up to 50 volume percent depending upon the physical properties desired for the metal matrix composite.

In forming dispersion strengthened or reinforced metal matrix composites, ingots of the matrix metal are typically melted in an induction furnace and the solid reinforcing particles are added in the desired amount to the molten metal to form a two-phase melt. As a result of induction stirring of the melt, the reinforcing particles are initially uniformly dispersed throughout the melt.

However, when the melt is subsequently cast in a permanent mold or a sand mold and solidified, a tendency for the solid reinforcing particles to agglomerate and form clusters in the casting has been observed. The presence of clusters of reinforcing particles in the cast metal matrix composite is highly undesirable as such clusters adversely affect the physical properties of the composite and/or their uniformity throughout the composite.

The invention resulted from the discovery that the objectionable clumping or agglomeration of the solid reinforcing particles in the cast metal matrix composite occurs in the relatively short time between transfer of the melt from the induction furnace and casting of the melt in the mold and also during solidification of the melt in the mold.

It is an object of the invention to provide a method of casting a metal matrix composite from an initially homogeneous, two-phase melt of solid reinforcing particles in a molten metal in such a manner as to minimize subsequent clumping or agglomeration of the reinforcing particles in the melt during various stages of the casting process and thus to minimize the presence of objectionable clusters of the reinforcing particles in the cast metal matrix composite.

It is another object of the invention to provide a method of casting a metal matrix composite by countergravity filling a mold cavity in a mold from an underlying, initially homogenous, two-phase melt of solid reinforcing particles in a molten metal while stirring the melt to minimize agglomeration or clumping of the reinforcing particles therein during countergravity mold filling.

It is a further object of the invention to stir the melt in the mold cavity after countergravity filling thereof and preferably even during solidification of the melt in the mold cavity to further minimize the presence of clumps or clusters of reinforcing particles in the solidifying melt.

SUMMARY OF THE INVENTION

The invention contemplates a method of casting a metal matrix composite including (a) providing a mold having a mold cavity therein and an ingate passage extending upwardly from a bottom side of the mold into communication with mold cavity, and (b) countergravity filling the mold cavity from an underlying melt having solid reinforcing particles initially substantially uniformly dispersed in a molten metal, including (1) immersing the bottom side of the mold in the melt, (2) establishing a differential pressure between the mold and the melt when the bottom side of the mold is immersed in the melt to urge the melt upwardly through the ingate passage into the mold cavity, and (3) stirring the melt during countergravity filling of the mold cavity to minimize subsequent agglomeration or clumping of the reinforcing particles in the melt during mold filling.

The invention also contemplates stirring the melt in the mold cavity after countergravity filling thereof and preferably during solidification of the melt in the mold cavity so as to minimize subsequent agglomeration or clumping of reinforcing particles in the solidifying melt and thus in the cast metal matrix composite.

In one embodiment of the invention, a gas permeable casting mold and a casting crucible containing the initially homogenous, two-phase melt are relatively moved to immerse the bottom side of the mold in the melt. A subambient pressure is applied to the mold cavity through the gas permeable mold when the bottom side thereof is immersed in the melt to urge the melt upwardly through the ingate passage and into the mold cavity to countergravity fill the mold cavity with the melt. An induction coil means positioned around the melt is energized during countergravity filling of the mold cavity to continuously stir or agitate the melt sufficiently to minimize agglomeration or clumping of the reinforcing particles in the melt during filling of the mold cavity. After the mold cavity is filled, the melt in the mold cavity is positioned in the field of the same or different energized induction coil means to gently stir the melt as it solidifies therein to minimize agglomeration or clumping of the reinforcing particles in the solidifying melt. The cast metal matrix composite resulting from practicing the method of the invention is characterized as having a substantially uniform distribution of the reinforcing particles in a metal matrix and few, if any, objectionable clusters or clumps of reinforcing particles in the metal matrix.

BRIEF DESCRIPTION OF THE DRAWINGS

The invention may be understood better when considered in light of the following detailed description of certain specific embodiments thereof which are given hereafter in conjunction with the following drawings.

DETAILED DESCRIPTION OF THE INVENTION

Figure 1:
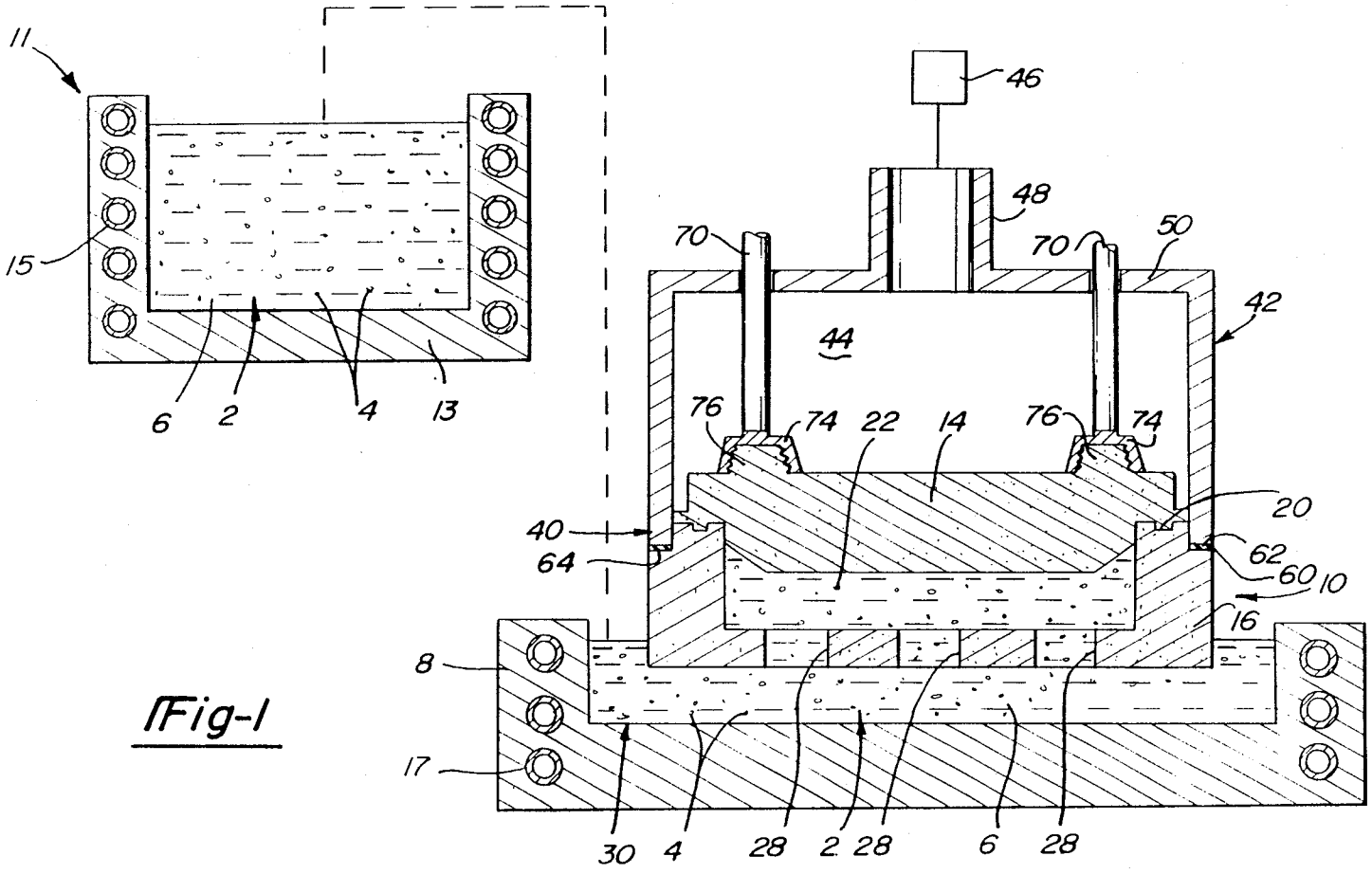
FIG. 1 is a sectioned elevational view of an apparatus for practicing one embodiment of the method of the invention.

In the drawings, the reference numerals are used for like parts or features in all of the Figures. Fig. 1 illustrates an apparatus for practicing the method of the invention wherein a melt 2 having solid reinforcing particles 4 (e.g., ceramic or metal fibers, whiskers, rods, spheres, etc.) initially uniformly dispersed in a molten metal 6 is contained in a casting crucible 8 which is positioned below a casting mold 10 to be filled in countergravity fashion with the melt 2.

The melt 2 is typically formed in a separate induction furnace 11 having a melting crucible 13 and one or more induction coils 15. Metal ingots (not shown) are placed in the melting crucible 13 and the induction coils 15 are energized by passing electrical current therethrough to inductively heat and melt the ingots. After the metal ingots are melted, the solid reinforcing particles 4 are added in the desired amount to the liquid metal 6 in the melting crucible 13 and substantially uniformly dispersed in the liquid metal 6 by the stirring or agitating action of the field of the energized induction coil 15. The resulting melt 2 with the reinforcing particles 6 substantially uniformly dispersed therein is transferred to the casting crucible 8 by direct pouring, ladling and the like as represented by the dashed line in FIG. 1.

After the casting crucible 8 is filled with the melt 2, an induction coil 17 disposed in the casting crucible 8 is energized to continuously stir or agitate the melt 2 in the casting crucible 8 during countergravity filling (or pouring) of the melt 2 into the mold 10 and preferably during solidification of the melt 2 in the mold 10 to minimize subsequent agglomeration or clumping of the initially homogenously distributed, solid reinforcing particles 4 in the melt 2 during these stages of the casting process as will be explained below.

FIG. 1 shows the casting mold 10 positioned above the casting crucible 8 and the initially homogenous, two-phase melt 2 contained therein. The casting mold 10 includes a porous, gas permeable upper mold portion 14 and a lower mold portion 16, which may be gas permeable or impermeable. The upper and lower mold portions 14,16 may be adhesively secured together along juxtaposed surfaces that define a mold parting plane or line 20, although the upper and lower mold portions 14,16 can be held together by other means.

Defined between the upper and lower mold portions 14,16 is the mold cavity 22 to be filled with the melt 2 through a plurality of ingate passages 28 on the bottom 30 of the mold 10 when the mold cavity 22 is evacuated with the bottom side 30 submerged in the melt 2. To this end, each ingate passage 28 extends upwardly from the bottom side 30 of the lower mold portion 1 into communication with the mold cavity 22 that is formed at least in part in the gas permeable upper mold member 14. Although a single mold cavity 22 is illustrated, multiple mold cavities may be defined in the mold 10 and supplied with the melt 2 by one or more ingate passages 28 for each mold cavity 22.

Upper and lower mold portions 14,16 can be made of resin-bonded sand in accordance with known mold practice wherein a mixture of sand or equivalent particles and bonding material is formed to shape and cured or hardened against a contoured pattern (not shown) having the desired complementary contour or profile for the parting surfaces and the mold cavities in the upper and lower mold portions. However, the invention is not so limited and may be used with other types of molds including gas permeable investment molds of the high temperature ceramic type illustrated in the Chandley et al U.S. Pat. Nos. 3,863,706 and 3,900,064 as well as gas impermeable molds.

The mold 10 is sealingly received in the mouth 40 of a housing 42 that defines a vacuum chamber 44 confronting the gas permeable, upper mold portion 14, FIG. 1. The vacuum chamber 44 is communicated to a vacuum source 46 through a conduit 48 sealingly connected to the upper end wall 50 of the housing 42 so that the mold cavity 22 can be evacuated through the gas permeable upper mold portion 14 to draw the melt 2 through the bottom ingate passages 28 when the lower mold portion 16 is immersed in the melt 2 in the casting crucible 8.

An annular, vacuum sealing gasket 60 is disposed between the housing 42 and the lower mold portion 16. In particular, the sealing gasket 60 is sealingly engaged and compressed between the bottom lip 62 of the housing 42 and an upwardly facing sealing surface 64 on the lower mold portion 16 by securing the mold 10 and the housing 42 together using, for example, multiple rotatable clamping shafts 70 (only two shown) having lower, internally threaded inverted cups 74. The internally threaded cups 74 are threadably engaged onto upstanding, threaded lugs 76 formed on the upper mold portion 14 to hold the mold 10 and the housing 42 together with the sealing gasket 60 compressed therebetween. A mold mounting arrangement of this type is described in U.S. Pat. No. 4,658,880 of common assignee herewith. Those skilled in the art will appreciate that other means may be used to hold the mold 10 and the housing 42 together.

To effect countergravity filling (or pouring) of the melt 2 into the mold cavity 22, the mold 10 and casting crucible 8 are relatively moved to submerge the bottom side 30 of the mold and the ingate passages 28 in the melt 2 and the vacuum chamber 44 is then evacuated to evacuate the mold cavity 22 through the upper mold portion 14. A differential pressure is thereby applied between the mold cavity 22 and the melt 2 (which is subjected to ambient pressure) to cause the melt 2 to flow upwardly through the ingate passages 28 in countergravity fashion to fill the mold cavity 22.

As mentioned hereinabove, the initially homogenous melt 2 in the casting crucible 8 is continuously stirred or agitated during countergravity filling of the mold cavity 22 as a result of energization of the induction coil 17 disposed in the casting crucible 8 around the melt 2. The induction coil 17 is energized at an electrical power level to continuously stir or agitate the melt 2 in the casting crucible 8 and to maintain desired melt temperature. The continuous stirring or agitation of the melt 2 minimizes subsequent agglomeration or clumping of the initially homogenously distributed, solid reinforcing particles 4 in the melt 2 during countergravity filling of the mold cavity 22. In this way, the solid reinforcing particles 4 are maintained substantially uniformly dispersed throughout the melt 2 prior to and during the countergravity filling of the mold cavity 22.

Following countergravity filling of the mold cavity 22 with the melt 2, the mold 10 may be withdrawn from the melt 2 after initial solidification of the melt 2 in the ingate passages 28 and while the melt 2 in the mold cavity 22 is still molten. The number and size of the ingate passages 28 to achieve initial solidification in the ingate passages will vary with the type of article to be cast and the particular metal to be cast as explained in U.S. Pat. No. 4,340,108.

Alternatively, the countergravity melt-filled mold 10 may be held with its bottom side 30 submerged in the melt 2 until the melt 2 in the ingate passages 28 and in the mold cavity 22 is solidified.

Figure 2:
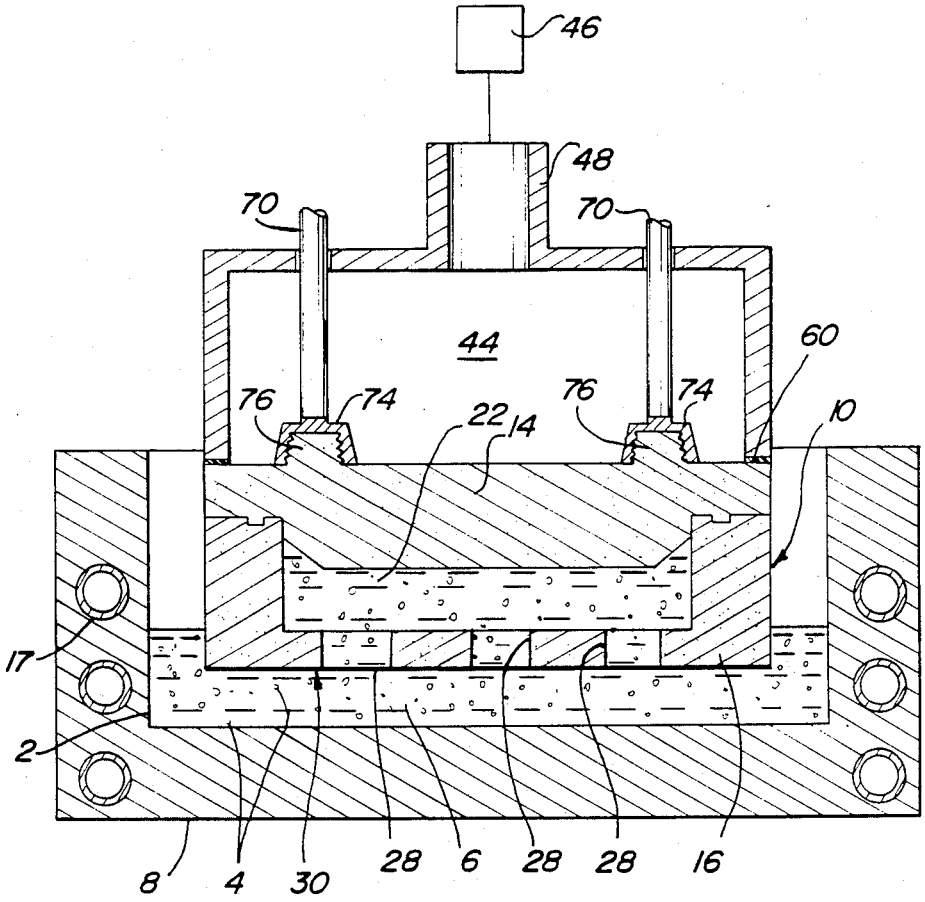
FIG. 2 is a sectioned elevational view of an apparatus for practicing another embodiment of the invention.

FIG. 2 illustrates another embodiment of the invention similar to that described hereinabove with respect to FIG. 1 in that the melt 2 is countergravity filled (or poured) into the mold cavity 22 in the same manner described hereinabove for FIG. 1 and differing therefrom in that the melt 2 is inductively stirred or agitated in the mold cavity 22 after countergravity filling thereof and during solidification of the melt 2 therein to further minimize agglomeration or clumping of the reinforcing particles 4 in the solidifying melt. In this embodiment, the induction coil 17 of FIG. 2 extends upwardly to a greater extent than it does in FIG. 1 so that the melt-filled mold cavity 22 is positioned within the field of the energized induction coil 17 when the bottom side 30 of the mold 10 is submerged in the melt 2 to effect countergravity filling of the mold cavity 22. The mold lo is retained in the lowered countergravity filling position in the casting crucible 8 after filling of the mold cavity 22 so as to subject the melt 2 in the mold cavity 22 to the influence of the field of the energized induction coil 17 sufficient to provide a slight stirring or agitation of the melt 2 as it solidifies in the mold cavity 22. This stirring or agitation of the melt 2 in the mold cavity 22 minimizes clumping of the reinforcing particles 4 in the solidifying melt and further minimizes the presence of agglomerations of the reinforcing particles 4 in the cast metal matrix composite. The mold 10 may be withdrawn from the casting crucible 8 after the melt 2 in the mold cavity 22 has either partially or fully solidified in the mold cavity 22 under the influence of the field of the energized induction coil 17.

The cast metal matrix composite resulting from the method of the invention is characterized as having the solid reinforcing particles 4 distributed substantially uniformly in the metal matrix with few, if any, objectionable clusters or clumps of reinforcing particles 4 in the metal matrix. Such a cast metal matrix composite will exhibit improved physical (mechanical) properties and uniformity of such properties compared to a metal matrix composite having numerous clusters of reinforcing particles therein. The machinability of a metal matrix composite cast in accordance with the method of the invention will also be improved.

Although the method of the invention has been illustrated hereinabove with respect to the countergravity filling or pouring of the melt 2 into the gas permeable mold 10 by applying a reduced, subambient pressure in the vacuum chamber 44 and thus in the mold cavity 22, those skilled in the art will appreciate that other techniques for establishing a differential pressure between the mold cavity 22 and the melt 2 may be used to urge the melt 2 upwardly into the mold cavity 22. For example, in the event a gas impermeable mold is used to practice the method of the invention, a superambient pressure may be applied to the melt 2 to urge it upwardly into the gas impermeable mold to fill one or more mold cavities therein.

Furthermore, although the melt 2 is described hereinabove as being formed initially in the induction furnace 11, the melt 2 may be formed directly in the casting crucible 8 by a similar procedure of melting metal ingots therein (by energizing induction coil ;7 sufficiently to melt the ingots) and then adding the solid reinforcing particles to the molten metal 6 in the casting crucible 8.

While the invention has been described in terms of specific embodiments thereof, it is not intended to be limited thereto but rather only to the extent set forth hereafter in the claims which follow.

I claim:

1. A method of casting a metal matrix composite having solid reinforcing particles substantially uniformly dispersed in a metal matrix, comprising:

(a) providing a mold having a mold cavity and an ingate passage extending upwardly from a bottom side of said mold into communication with the mold cavity, (b) countergravity filling the mold cavity from an underlying melt initially having solid reinforcing particles substantially uniformly dispersed in a molten metal, including (1) immersing the bottom side of the mold in the melt, (2) establishing a differential pressure between the mold cavity and the melt when said bottom side is immersed in the melt sufficient to urge the melt upwardly through the ingate passage into the mold cavity to countergravity fill the mold cavity with the melt and (3) inductively stirring the melt during countergravity filling of said mold cavity with the melt such as to substantially maintain said uniform dispersion and to minimize subsequent agglomeration of the reinforcing particles therein during filling of said mold cavity, and (c) inductively stirring the melt in said mold cavity after countergravity filling thereof to minimize subsequent agglomeration of the reinforcing particles in the melt filling the mold cavity.

2. The method of claim 1 wherein in step (c) the melt is inductively stirred as it solidifies in the mold cavity.

3. A method of casting a metal matrix composite having solid reinforcing particles substantially uniformly dispersed in a metal matrix, comprising:

(a) providing a mold having a mold cavity and an ingate passage extending upwardly from a bottom side of said mold into communication with the mold cavity, (b) countergravity filling the mold cavity from an underlying melt initially having solid reinforcing particles substantially uniformly dispersed in a molten metal, including (1) immersing the bottom side of the mold in the melt, (2) establishing a differential pressure between the mold and the melt when said bottom side is immersed in the melt sufficient to urge the melt upwardly through the ingate passage into the mold cavity to countergravity fill the mold cavity with the melt and (3) energizing induction coil means disposed around the melt to inductively stir the melt during countergravity filling of the mold cavity with the melt such as to maintain said uniform dispersion and to minimize subsequent agglomeration of the reinforcing particles therein during filling of the mold cavity, and (c) positioning the melt-filled mold cavity in the field of the energized induction coil means to inductively stir the melt therein to minimize subsequent agglomeration of the reinforcing particles in the melt filling the mold cavity.

4. The method of claim 3 wherein in step (c) the melt in the mold cavity is inductively stirred as it solidifies.

* * * * *

UNITED STATES PATENT AND TRADEMARK OFFICE

CERTIFICATE OF CORRECTION

PATENT NO. : 4,901,781

DATED : February 20, 1990

INVENTOR(S) : Gary F. Ruff

It is certified that error appears in the above-identified patent and that said Letters Patent is hereby corrected as shown below:

Column 5, line 24, delete "1o" and insert --10-- therefor.

Signed and Sealed this

Fifteenth Day of June, 1993

*Attest:*

Michael K. Kirk

MICHAEL K. KIRK

*Attesting Officer*

*Acting Commissioner of Patents and Trademarks*